United States Patent [19]

Newkirk

[11] Patent Number: 4,731,063

[45] Date of Patent: Mar. 15, 1988

[54] DISPOSABLE ANTISEPTIC DEODORIZED INSERT FOR A SUPPORTER OR THE LIKE

[75] Inventor: Reginald H. Newkirk, Sherman Oaks, Calif.

[73] Assignee: Newkirk Enterprises, Inc., Sherman Oaks, Calif.

[21] Appl. No.: 766,242

[22] Filed: Aug. 16, 1985

[51] Int. Cl.[4] ..... A61F 5/40

[52] U.S. Cl. ..... 604/347; 128/158; 604/360; 604/369

[58] Field of Search ..... 604/359, 360, 358, 351, 604/353, 347, 385, 396, 397, 398, 399, 346, 369; 128/158, 161, 162, 132 R

[56] References Cited

U.S. PATENT DOCUMENTS

| | | | |
|---|---|---|---|
| 713318 | 11/1902 | Lovis . | |
| 1,989,686 | 2/1935 | Deutsch . | |
| 2,427,428 | 9/1947 | Vitale | 128/158 |
| 3,072,123 | 1/1963 | Davis | 604/369 |
| 3,088,462 | 5/1963 | Muto | 604/369 |
| 3,212,501 | 10/1965 | Goldstein | 604/398 |
| 3,314,422 | 4/1967 | Phillips | 128/132 R |
| 3,616,798 | 11/1971 | Garfinkel | 604/370 |
| 3,664,336 | 5/1972 | Gelston . | |
| 4,244,059 | 1/1981 | Pflaumer . | |

*Primary Examiner*—John D. Yasko
*Assistant Examiner*—Denise Whelton
*Attorney, Agent, or Firm*—Poms, Smith, Lande & Rose

[57] ABSTRACT

A disposable treated insert for use with a supporter, brief, undergarment or the like having an insert body member of foam material treated with fungicide and deodorant materials and comprising a lower pouch portion for enclosing and supporting male genitals and an upper panel portion for conforming the body member to an adjacent body surface to stabilize the position of the pouch portion when held in position by support means.

3 Claims, 6 Drawing Figures

DISPOSABLE ANTISEPTIC DEODORIZED INSERT FOR A SUPPORTER OR THE LIKE

BACKGROUND OF INVENTION

This invention relates to a disposable medically treated insert for reception of male genitals and worn with suitable supporting means such as a supporter, brief or other undergarment for the purpose of inhibiting bacterial growth, skin irritation and suppressing undesirable odors.

In addition to the many organized athletic activities in schools, colleges and professional sports, the past few years have included the establishment of a great number of athletic facilities for individuals. The number of participants in such private athletic activities has tremendously increased. Such athletic facilities usually provide a service of laundering and care in a sanitary manner of the clothes worn by the participants including supporters, briefs, shorts, sweatsuits and the like which become soaked with perspiration and body skin discharges. In some such facilities the laundered article is personalized, returned to the owner, and not likely to be worn by others as in other group laundering facilities. In either circumstance, the purportedly clean sanitarized article may carry undesirable bacteria still transferable to the succeeding wearer of the article, whether the succeeding wearer is the same individual or another person.

While such athletic facilities may be careful in handling such articles during sanitarization and laundering thereof, it is still possible that such socalled clean articles may contain bacteria. When the article is again worn under conditions of vigorous activity producing perspiration and body heat, growth of bacteria, fungus and other undesirable skin irritation may again rapidly occur.

Prior proposed devices relating to the care of this region of the human body have included a medicated sanitary pad as disclosed in U.S. Pat. No. 1,989,686; a suspensory bandage employing a penis receptacle as shown in U.S. Pat. No. 713,318; a disposable athletic supporter as disclosd in U.S. Pat. No. 3,664,336 in which a material such as "handi-Wipes" is used to absorb quantities of fluid; and U.S. Pat. No. 4,244,059 in which a brief or nether garment is provided with a soft non-bunching air permeable crotch panel. The sanitary pad of U.S. Pat. No. 1,989,686 was attached by safety pins to a band; the suspensory bandage of U.S. Pat. No. 713,318 was complicated in structure and not disposable; the disposable athletic supporter of U.S. Pat. No. 3,664,336 involved a nonwoven material designed according to preferential directions of strength and resilience at right angles, pleating of a waistband and a complex construction of a supporter. These prior proposed devices approach the problem of medically caring for the male genital area in a manner quite different than the disposable medicated treated insert member of this invention.

SUMMARY OF INVENTION

The present invention contemplates a solution to the problems mentioned above by providing a disposable insert device which will inhibit bacterial growth, which will suppress, reduce, and virtually eliminate undesirable body odors and which when once worn after an athletic workout can be disposed of by throwing the used insert away. The invention is therefore directed to a disposable inexpensive insert body member which may be readily worn, which absorbs perspiration and which may medically treat fungus on the adjacent body portions.

An object of the invention is to provide a disposable insert which has been treated to inhibit bacterial growth and to suppress or eliminate offensive odors.

Another object of the invention is to provide an inexpensive and readily manufactured insert body member of suitable foam material.

Another object of the invention is to provide a medically treated insert body member of foam material which is so shaped as to be comfortable to wear.

A still further object of the invention is to provide an insert body member adapted to be used beneath a supporter, brief or other undergarment and so constructed as to be readily held in a stabilized position against surfaces of the body.

Another object of the invention is to provide a compliant, soft, yieldable absorbant, relatively thin insert body member adapted to absorb perspiration, inhibit bacterial growth and suppress or eliminate body odors.

The invention particular contemplates a disposable insert body member of treated open cellular foam material including two elongated identical panels adapted in storage condition to be superimposed in parallel planes. Each panel has a top edge, a side edge and a continuous edge joining one hand of the top edge with one end of the side edge, said continuous edge having an upper concave edge portion extending from the top edge and a lower convex edge portion extending to said one end of said side edge the continuous edges of the superimposed panels being joined continuously by a seam whereby the upper panel portions joined by the concave edge portions conform to adjacent abdomen body surfaces over a selected area and the lower panel portions joined by the convex edge portion to form a pouch when the side edges are spread apart to receive and support the male genitals. The invention further contemplates treatment of the open cellular foam material such as by a fungicide for example, zinc undecylenate and undecylenic acide in a talc base.

Other objects and advantages of the present invention will be readily apparent from the following description of the drawings in which an exemplary embodiment of the invention is shown.

IN THE DRAWINGS

DETAILED DESCRIPTION OF INVENTION

Figure 1:
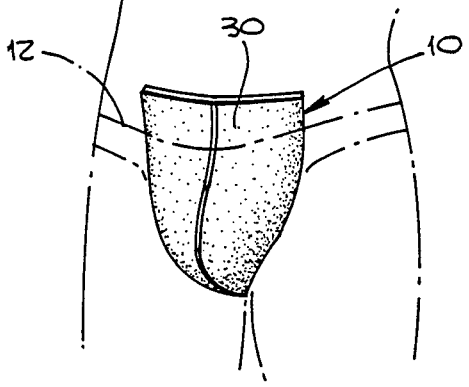
FIG. 1 is a view showing an insert body member embodying this invention as worn by a male person.

In FIG. 1 a fragmentary portion of a male body is shown with an insert body member embodying this invention generally indicated at 10 as being worn by such individual and held in place by a supporter 12 indicated by phantom lines. It will be understood that the supporter 12 may be a jock type supporter, a brief, or any other type of undergarment worn about the pelvic region of the body and having some elasticity or means for securing and holding the insert body member 10 in contact with the body.

The insert body member 10 generally comprises a pair of identically shaped panels 14 of suitable foam or spongelike material such as a double cell polyether. The foam material may have an open cellular structure with a selected porosity to provide aeration or breathing through the material. The foam material is soft, compliant, absorbant and adapted to be cut in various thicknesses depending upon the athletic activity in which the insert is to be worn. The foam material may be treated with suitable fungicides to inhibit bacterial growth such as "Tinactin" which generally comprises a a zinc undecylenate 20% and an undecylenic acide 2% in a talc base. The talc base is for providing a freshness to the smell of the insert. It will be understood that other fungicides may be employed, the foam material may be antiseptically treated, and may also be treated with a deodorant and disinfectant. The treated foam material when placed against the skin surface of the body where the insert is worn provides a skin contacting surface which tends to prevent irritation of the skin during the athletic workout and also may inhibit the growth of rash or other dermatitis conditions.

Figure 2:
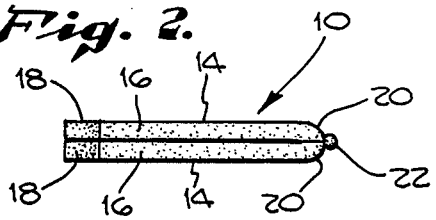
FIG. 2 is an end view of the insert member in normal collapsed or storage position.
Figure 3:
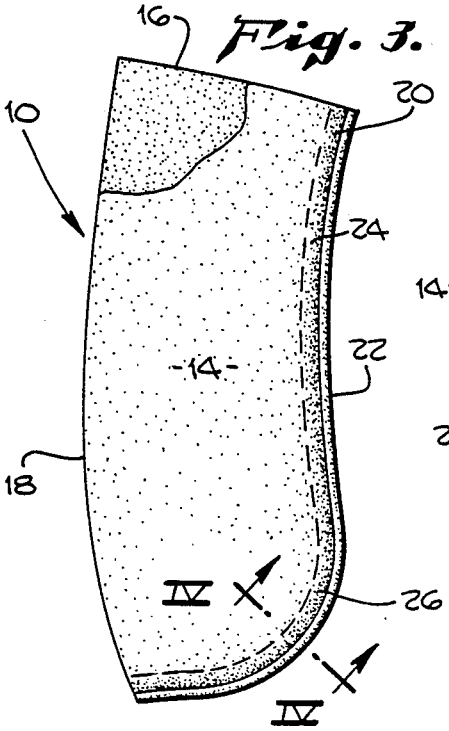
FIG. 3 is a side elevational view of the insert member of FIG. 2.
Figure 4:
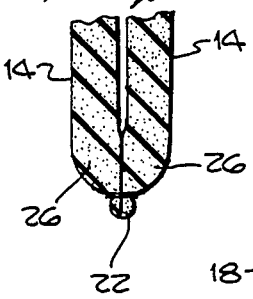
FIG. 4 is a section taken in the plane indicated by the line IV—IV of FIG. 3 .

The insert body member 10 as shown in FIGS. 2 and 3 may comprise two identical panels 14 which, in collapsed or storage condition, lie in superimposed parallel planes. Each panel 14 includes a relatively straight top edge 16, a side edge 18 of slightly convex curvature and a continuous curved edge 20 opposite edge 18 and extending from the top edge 16 continuously to the lower end of side edge 18. The continuous edges 20 are joined together by a seam 22 formed in any suitable manner as by stitching or welding of the foam material. The continuous edge 20 is formed with an upper slightly concave edge portion 24 which merges adjacent the bottom portion of the panel with a convex edge portion 26 having a suitably selected radius and extending through an arc of approximately 90°.

Figure 5:
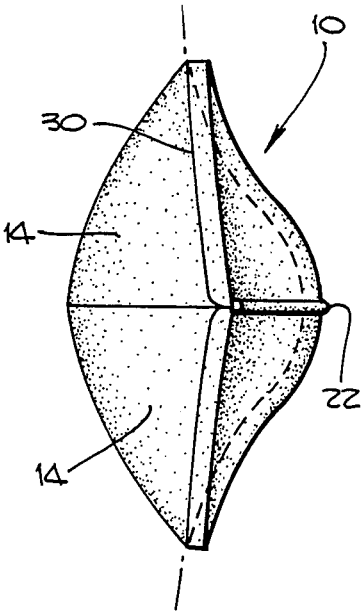
FIG. 5 is a top view showing the insert body member in an open wearable position.
Figure 6:
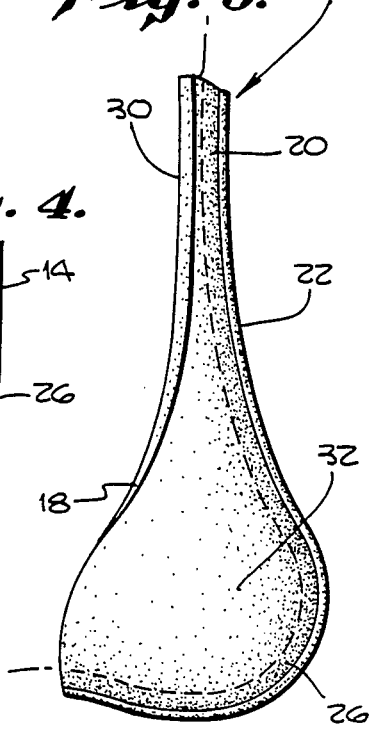
FIG. 6 is a side view of FIG. 5 showing the lower pouch portion and the upper panel like portion of the insert member in open wear position.

The configuration and shape of the panels 14 together with the compliant foam material of the panels form as shown in FIGS. 5 and 6 an insert body member which, when the upper portions of the panels are opened and spread into almost common planar relation, provides an upper relatively flat portion 30 readily adapted to conform to the abdomen surface of the body above the male genitals. When opened as shown in FIG. 5, the lower porions of panels 14 form a lower pouch portion 32 of a size readily adapted to receive and support the male genitals of the body. The compliancy of the material together with the shape automatically formed by opening panels 14 about seam 22 permits the side edges 18 to readily conform with the groin configuration of the individual's body, that is the depression between the lower abdomen and the inner part of the thigh. The pouch portion so formed comfortably and snugly accomodates and supports the male genitals while the upper panel portions readily conform to the curvature of the lower abdomen and spread over a suitable area thereof. Thus, when a supporter or brief is worn over the insert body member, the area of the upper panel portion 30 is lightly and snugly pressed over the skin surface of the abdomen and serves to stabilize the position of the lower pouch portion.

It will thus be readily apparent that the insert body member of this invention embodies a simple method of fabrication of a three dimensional wearable pouch means which may be readily conveniently stored in minimum space by the collapsed arrangement of the identical panels 14. Such insert body members are inexpensive to manufacture because the panels 14 are identical and may be readily stamped from superimposed sheets of blank foam material and readily welded or stitched along continuous edges 22. The application of fungicide and other materials for treating the foam may be readily accomplished by spraying with atomized liquid or powder the sheet stock material prior to cutting of the panels 14; or the panels 14 may be readily sprayed or dusted with the treating material after being cut to shape and before forming the seam. It will be apparent that the treating material is preferably applied to at least the inner body contacting surfaces of the insert body member.

It should be noted that the type of foam material which is used for the insert body member may also have a cellular structure adapted to cushion impact forces such as those received when playing football, soccer, etc. In such uses a thicker foam material may be used.

The selection of the fungicide deodorants and requires avoidance of any materials which might tend to cause irritation of intimate parts of the body. If the use of a fragrant material is desired for cosmetic purposes and for marketing of the product, such fragrant material may be in the form of an independent packet separable from the insert member.

Various changes and modifications may be made in the insert body member described above and all such modifications and changes coming within the scope of the appended claims are embraced thereby.

I claim:

1. A disposable insert for use with a supporter or the like, comprising:

an insert body member of antiseptically treated open cellular foam material comprising two elongated pre-cut and preshaped identical flat panels, each of said flat panels having a top linear edge;

a side edge convex for the length of the panel and having one end contiguous with one end of the top edge;

and a continuous edge joining the other end of the top edge with the other end of the side edge;

said continuous edge having an upper elongated concave edge portion extending from the top edge for a major portion of the length of the panel, and a lower relatively short convex edge portion subtending an angle of approximately 90° and extending to said other end of the side edge;

the continuous edges of the panels being joined by a seam to form a flat pre-shaped unitary insert body member;

the two pre-shaped joined panels lying in parallel planes and conforming in shape to each other;

the width of each panel between said side edge and said concave edge portion being substantially uniform;

said side edges when separated and each moved through an angle of approximately 90° about said seam, forming the top edges into a continuous slightly concave top edge to provide a substantially wide upper body member portion to conform to adjacent abdomen body surfaces;

said lower convex edge portions upon separation of said side edges forming a lower body member portion of three-dimensional pouch form having an internal concave continuous surface comfortably accommodating male genitals and margins conforming to the groin area.

2. A disposable insert as claimed in claim 1 wherein the width of the panel between the side edge and the convex edge portion being rapidly diminished and not exceeding the width of the panel between the side edge and the concave edge portion.

3. A blank of antiseptically treated foam material for assembly with an identical blank to form a disposable insert for use as a supporter or the like when the blanks are joined along one edge and are separated and expanded about said one edge, comprising:

a top edge;

a first side edge sligtly convex for its entire length;

a second side edge of concave configuration for a major portion of its length and substantially uniformly spaced from said first side edge;

said second edge merging with a convex edge subtending an angle of approximately 90° to terminate at one end of said first side edge;

said second side edges and convex edges being joined to form a common connecting edge;

whereby, when said blanks are joined along said common connecting edge and the panels expanded, the extremity of the short convex edge which merges with the end of said first side edge is caused to lift and to facilitate forming a pocket for accommodation of male genitals.

* * * * *